United States Patent [19]

Moffitt, Jr.

[11] 4,370,072

[45] Jan. 25, 1983

[54] UTILITY BRUSH

[76] Inventor: Merritt L. Moffitt, Jr., 9 Weirwood Rd., Radnor, Pa. 19087

[21] Appl. No.: 252,761

[22] Filed: Apr. 10, 1981

Related U.S. Application Data

[63] Continuation of Ser. No. 62,320, Jul. 30, 1979, abandoned.

[51] Int. Cl.[3] ..... A46B 11/04; B65B 1/06

[52] U.S. Cl. ..... 401/276; 137/539; 141/18; 141/110; 222/397; 401/120; 401/189; 401/206; 401/273

[58] Field of Search ..... 401/272, 273, 224, 276, 401/278, 279, 286–288, 141, 120, 187, 203, 204, 206; 137/539, 540; 222/397; 141/18, 110

[56] References Cited

U.S. PATENT DOCUMENTS

| | | | |
|---|---|---|---|
| 180,242 | 7/1876 | Niest | 47/79 |
| 378,524 | 2/1888 | Rutherford | 401/187 |
| 605,146 | 6/1898 | Stokes | 141/110 |
| 1,305,964 | 6/1919 | Dickson | 137/539 |
| 1,453,152 | 4/1923 | McVicker | 401/189 |
| 2,379,421 | 7/1945 | Brooke | 401/187 |
| 2,517,152 | 8/1950 | Wilson | 401/273 |
| 2,556,003 | 6/1951 | Sandell | 401/206 |
| 2,586,715 | 2/1952 | Richeson | 137/539 |
| 2,737,329 | 3/1956 | Bolsey | 401/141 |
| 3,119,142 | 1/1964 | Fletcher | 401/273 |
| 3,473,443 | 10/1969 | Mikkelsen | 137/539 |
| 3,871,553 | 3/1975 | Steinberg | 222/397 |
| 4,144,915 | 3/1979 | Henderson | 141/18 |

FOREIGN PATENT DOCUMENTS

| | | | |
|---|---|---|---|
| 766228 | 4/1934 | France | 401/276 |
| 971658 | 8/1950 | France | 141/110 |
| 271061 | 12/1950 | Switzerland | 401/276 |

*Primary Examiner*—Clyde I. Coughenour
*Attorney, Agent, or Firm*—John J. Simkanich

[57] ABSTRACT

A utility brush usable to wash various objects includes a brush head and a handle member, the former including cleaning means such as bristles extending from one face thereof. Also included are port means formed through the head to provide communication between the cleaning means and a reservoir containing a cleaning fluid whereby the cleaning fluid can be fed into and out of the reservoir. Associated with the reservoir means is check valve means for allowing air to be exhausted from the reservoir during filling and for maintaining the reduced pressure in the reservoir means during the release of the cleaning fluid.

10 Claims, 5 Drawing Figures

UTILITY BRUSH

This is a continuation, of application Ser. No. 62,320, filed July 30, 1979, now abandoned.

This invention relates to utility brushes and, more particularly, to utility brushes including integral reservoir means containing a supply of cleaning fluid.

The cleaning of various objects, for example, cars or other motor vehicles, requires the use of a brush and a cleaning fluid such as soapy water. Normally the soapy water is retained in a bucket and the cleaning brush is dipped into the bucket absorbing the soapy water. The brush is then placed on the vehicle allowing the soapy water to run on the surface to be cleaned and the brush is used to scrub that surface in the usual manner. This technique is time consuming and provides only small amounts of the cleaning fluid on the object to be cleaned unless the brush is continually dipped into the bucket.

There is known in the art, a combination reservoir-brush, in which the brush is associated with a cleaning fluid reservoir. To fill the reservoir requires some manipulation of a check valve and is thus time consuming. To release the fluid, a capillary action is utilized and this too is relatively time consuming. See U.S. Pat. No. 1,047,338.

Accordingly, it is an object of this invention to provide a utility brush with a reservoir means associated therewith for a cleaning fluid.

It is another object of this invention to provide a combination utility brush and reservoir which is arranged to provide for fast filling of the reservoir with the cleaning fluid and the slow release of the cleaning fluid during the actual cleaning operation.

It is another object of this invention to provide a utility brush and reservoir for cleaning fluid which includes a simple, efficient check valve means.

Finally, it is an object of this invention to provide a utility brush with a reservoir means associated therewith that permits efficient cleaning of various objects and that is relatively simple and economical.

These and other objects of this invention are realized by providing a utility brush including a brush head and a handle member. The brush head is formed with cleaning means extending from one face thereof and being formed with port means communicating between the exterior surface of the brush head adjacent the cleaning means and reservoir means in which a cleaning fluid can be contained. Associated with the reservoir means is a check valve means for allowing the escape of air from the reservoir when it is being filled with a cleaning fluid and for maintaining a reduced air pressure in the reservoir when the cleaning fluid is being released. With this arrangement the reservoir can be filled rather quickly but the release of the cleaning fluid is somewhat slower.

For a better understanding of the invention, reference is made to the following description of several preferred embodiments thereof taken in conjunction with the figures of the accompanying drawing in which.

Figure 1:
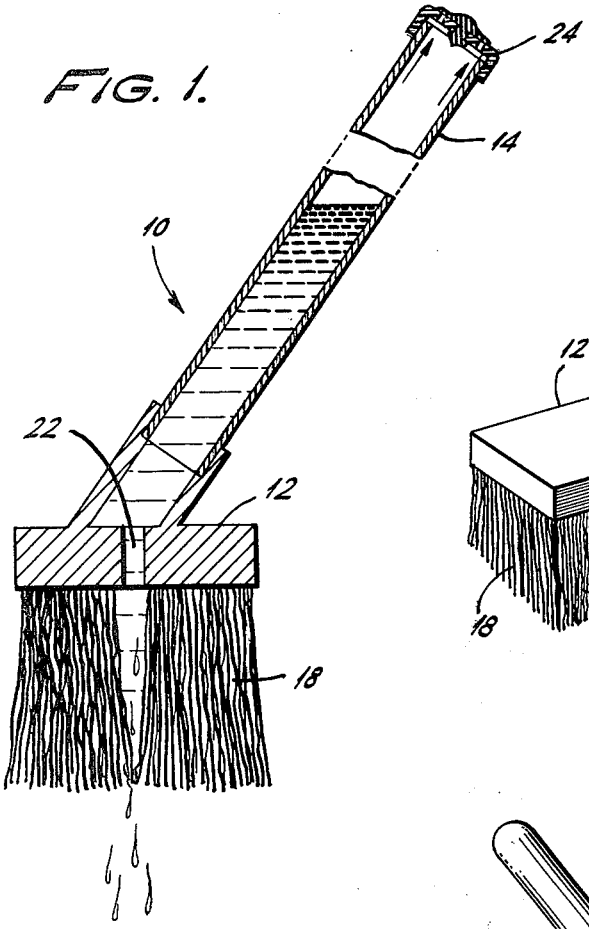
FIG. 1 is a side elevation view, in section, illustrating a first embodiment of the invention.
Figure 2:
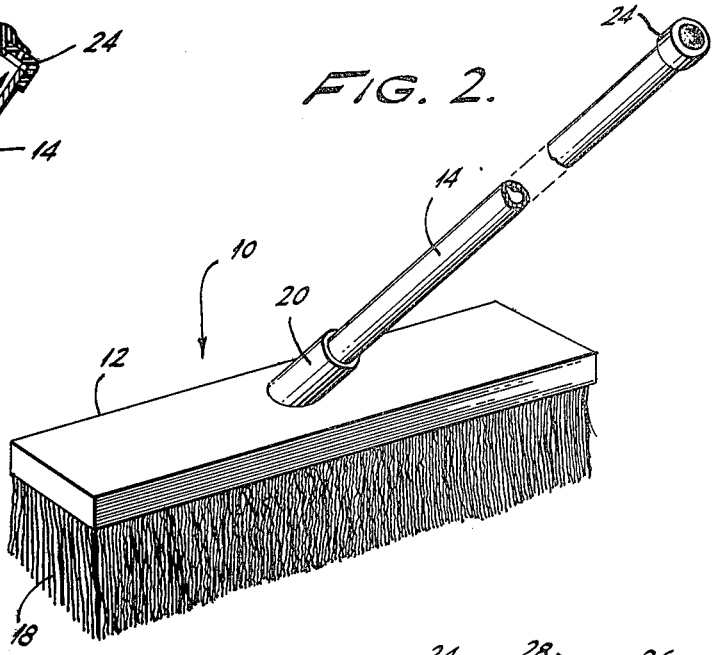
FIG. 2 is a perspective view of the utility brush illustrated in FIG. 1.
Figure 3:
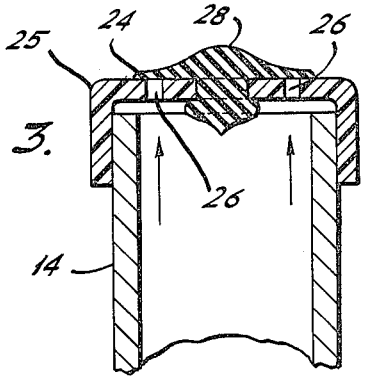
FIG. 3 is an enlarged view of the free end of the handle illustrated in FIG. 1.

Referring to FIGS. 1 through 3 of the drawing, there is illustrated a utility brush 10 in accordance with this invention. The brush 10 includes a brush head 12 and a handle member 14. The brush head 12 is a generally rectangular member which can be made of any generally conventional material. Extending from one face of the brush head are generally conventional bristles 18 which can be used in the usual manner to scrub and loosen dirt on the object to be cleaned. It should be understood that the bristles 18 could be replaced with other cleaning or scrubbing means.

Located centrally on the face of the brush head 12 opposite that from which the bristles 18 extend, is a generally hollow cylindrical socket 20 which receives the handle member 14. The handle member 14 is hollow and forms, along with the socket 20, a reservoir in which a cleaning fluid can be contained. The cleaning fluid is clearly illustrated in FIG. 1 of the drawing and can be soapy water or other cleaning fluids.

Communicating with the reservoir for filling and releasing the fluid, there is provided a port means in the form of a cylindrical opening 22 extending from the face of the head member 16 from which the bristles 18 extend through the opposite face thereof in the region of the socket 20. Thus, the cleaning fluid can flow through the opening 22 into the reservoir when the brush is dipped into a container of the cleaning fluid and the cleaning fluid can be released through the opening to the surface to be cleaned. This flow is usually induced by gravity.

In order to provide for the rapid filling of the reservoir and a generally slow release of the cleaning fluid therefrom, there is provided check valve means generally indicated at 24 and as best seen in FIG. 3 of the drawing. The check valve means 24 includes a closure member 25 fitted over the free end of the handle 14 which is formed with a plurality of openings 26 communicating between the interior of the reservoir and the atmosphere. Associated with the openings 26 is a valve member 28 comprised of rubber closure member secured to the member 25 at its center so that its outer area normally seats over and closes the openings 26. When the utility brush is placed into the tank of the cleaning fluid, the cleaning fluid flows through the opening 22 and into the reservoir compressing the air in the reservoir which forces the outer area of the valve member 28 away from the openings exhausting the air to the atmosphere. For facilitating the exhaust of the air, the valve member 28 should be made of a light, flexible material. After filling the atmospheric pressure is sufficient to retain the closure member 28 over the openings 26 so that leakage of air into the reservoir is inhibited. Thus, during the cleaning operation, the fluid flows at a substantially reduced rate through the opening 22. This is because there is a generally greater pressure acting on the outside of the ports 22 than on the reservoir side of the port 22.

Figure 5:
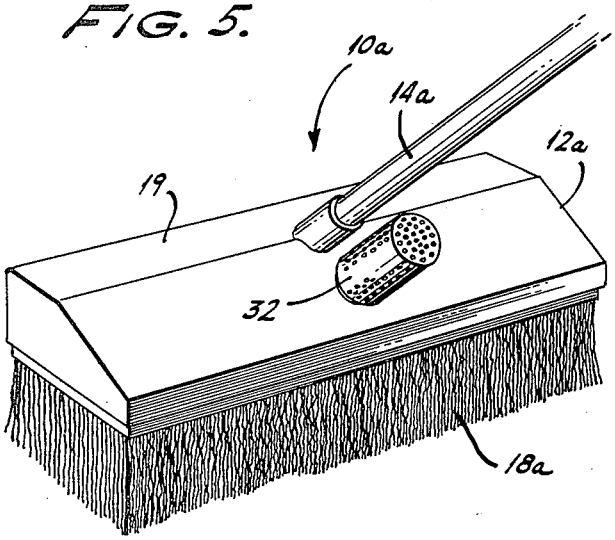
Figure 4:
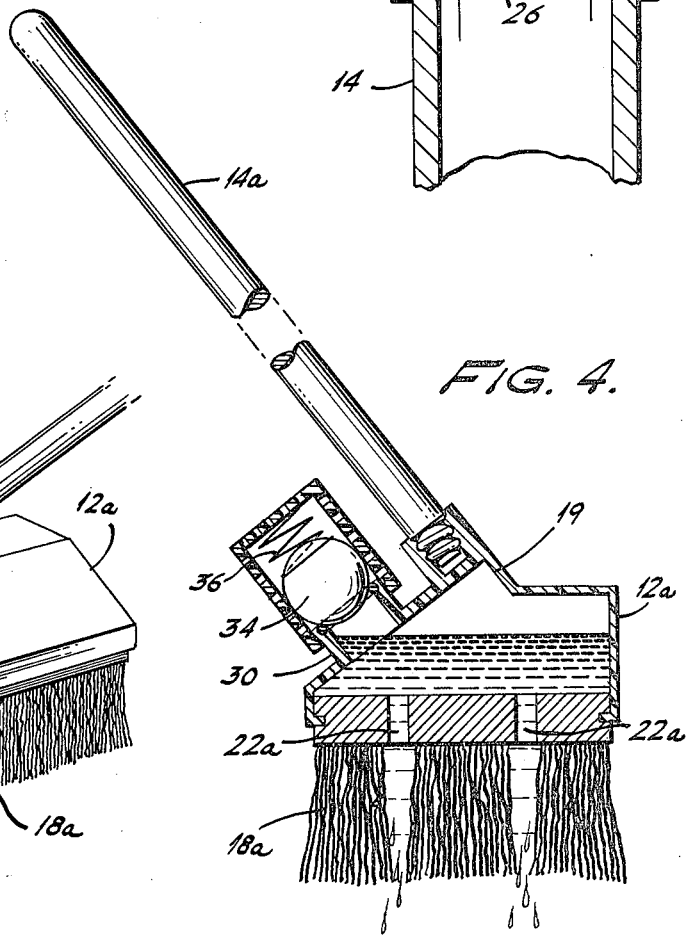
FIG. 4 is a side elevation view, partly in section, illustrating another embodiment of the invention; and, FIG. 5 is a perspective view of the utility brush illustrated in FIG. 4.

Referring to FIGS. 4 and 5, there is illustrated another embodiment 10*a* of a utility brush in accordance with this invention. In describing the embodiment, like reference numerals will designate like parts with the addition of the suffix *a*. In this embodiment there is also provided a brush head 12*a* and a handle 14*a*. The brush head 12*a* is generally rectangular and bristles 18*a* extend from one face in a manner similar to that in FIGS. 1 through 3. Carried about the opposite face of the head member 16*a* is a suitable housing 19 which is secured to and cooperates with the brush head 16*a* to form a reservoir for cleaning fluid. The cover 19 may be secured into the brush head member 16*a* in any suitable fashion it being important that an effective seal preventing leakage be provided. In this embodiment the edges of the housing are embedded in the sides of the brush head 16*a*. The outer surface of the cover 19 can be formed with a threaded socket for receiving the handle 14*a*.

Formed through the head member 16*a* are a plurality of openings 22*a* similar to the opening 22 illustrated in FIGS. 1 through 3. In this embodiment, however, there can be provided a plurality of openings 22*a* so that the release of the cleaning fluid is more uniformly distributed throughout the working area of the bristles 18*a*.

There is also provided a check valve means 24*a* for allowing the escape of air during the filling operation and for thereafter maintaining a reduced air pressure on the fluid in the reservoir. The check valve member 24*a* includes a cylindrical sleeve 30 formed in the housing 19 and communicates between the interior of the reservoir and with the atmosphere. The cylindrical sleeve 30 is closed by a closure member in the form of a cage 32 so that the closure also communicates with the atmosphere. Inside the cage 32 is located a lightweight ball valve member 34 that cooperates with the free end of the sleeve 30 to allow or prevent the flow of air. The ball valve member 34 can be a hollow table tennis ball or a ball of about that height. The ball valve 34 is normally retained in the closed position by a relatively light spring member 36 so that only a small pressure differential is required to open the valve.

In use, the utility brush 10*a* can be placed in a container of cleaning fluid so that the cleaning fluid flows through the openings 22*a* into the interior of the housing 19. As the liquid enters, it forces the air, by compression, to open the ball valve member 34 allowing the escape of air through the cage 32. The cleaning fluid can, if the reservoir is filled to the top fill the inside of the cage member 32. The lightweight ball valve member 34 will float on the surface of the cleaning fluid and will close against the sleeve 30 as the level of the cleaning fluid recedes. Once the filling is complete, the spring 36 urges the ball valve member 34 back against the sleeve 30 closing the valve and inhibiting the flow of air back into the reservoir. This means a reduced air pressure is maintained in the reservoir so that there is a slow discharge of the fluid.

While in the foregoing there have been disclosed preferred embodiments of the invention it should be obvious to those skilled in the art that various changes and modifications can be made without departing from the spirit and scope of the invention as recited in the appended claims.

I claim:

1. A utility brush comprising:

a brush head;

means for cleaning extending from one side of said brush head;

port means for communicating through said brush head from said cleaning means side to the other side thereof;

reservoir means for containing a liquid, said reservoir means being connected to said port means at said brush head other side and having an opening in the top thereof; and check valve means, associated with said reservoir means at said top opening, being biased to the closed position for maintaining a reduced pressure in said reservoir means when said reservoir means is subjected to emptying through said port means connection, said check valve means closing force being less than the pressure upon it created by the liquid head on said reservoir means when submerged for filling under atmospheric pressure and for venting said reservoir means when said reservoir means is subjected to filling from below through said brush head port means connection.

2. A utility brush in accordance with claim 1 wherein said handle member is hollow and forms said reservoir means.

3. A utility brush in accordance with claim 2 wherein said handle member extends from the opposite face of said brush head and wherein check valve means comprises vent means located in the free end of said handle member and communicating with the atmosphere and a soft rubber valve member normally overlying said vent means.

4. A utility brush in accordance with claim 1 wherein said check valve means comprises a vent extending into said reservoir means on a side thereof away from said connection to said brush head and a valve member operatively associated with said vent and positioned outside of said reservoir means.

5. A utility brush in accordance with claim 1 wherein said reservoir means includes a housing secured to said brush head on a side thereof opposite said cleaning means.

6. A utility brush in accordance with claim 5 also including a handle connected to said housing.

7. A utility brush in accordance with claim 5 wherein said vent includes a sleeve member extending outwardly from said housing formed with a valve seat and an opening extending through said housing wall, said valve member operating against said valve seat.

8. A utility brush in accordance with claim 7 wherein said valve member is a ball and further including a spring exerting a light force on said ball for biasing said ball against said valve seat.

9. A utility brush in accordance with claim 8 further including a cage carried on said sleeve member, said spring and said ball being retained within said cage.

10. A utility brush in accordance with claim 9 wherein said cage permits free flow therethrough and said ball is of light weight whereby the combined weight of said ball and said spring force is less than the air pressure created by ingress of fluid on filling so as to lift off said ball from said valve seat when said housing is subjected to positive pressure on filling and to seat said ball on said valve seat when said housing is subjected to negative pressure on emptying.

* * * * *